US005531615A

United States Patent [19]

Irlbeck et al.

[11] Patent Number: 5,531,615

[45] Date of Patent: Jul. 2, 1996

[54] COPLANAR COMPUTER DOCKING APPARATUS

[75] Inventors: Robert D. Irlbeck, Greensboro; Robert M. Renn, Pfafftown; Keith L. Volz, Jamestown; Frederick R. Deak, Kernersville; David C. Johnson; Warren A. Bates, both of Winston-Salem, all of N.C.

[73] Assignee: The Whitaker Corporation, Wilmington, Del.

[21] Appl. No.: 372,702

[22] Filed: Jan. 13, 1995

Related U.S. Application Data

[63] Continuation of Ser. No. 102,659, Aug. 5, 1993, abandoned.

[51] Int. Cl.[6] ..... H01R 23/70

[52] U.S. Cl. ..... 439/631; 439/377; 439/633

[58] Field of Search ..... 439/492, 493, 439/498, 67, 77, 842, 843, 833, 839, 630–637, 377

[56] References Cited

U.S. PATENT DOCUMENTS

| | | | |
|---|---|---|---|
| 3,149,896 | 9/1964 | Hall | 439/77 |
| 4,080,027 | 3/1978 | Benasutti | 439/67 |
| 4,660,920 | 4/1987 | Shibano | 439/724 |
| 4,969,824 | 11/1990 | Casciotti | 439/67 |
| 4,981,449 | 1/1991 | Butcher | 439/724 |
| 5,156,553 | 10/1992 | Katsumata et al. | 439/493 |
| 5,240,420 | 8/1993 | Roberts | 439/493 |

*Primary Examiner*—David L. Pirlot

[57] ABSTRACT

The invention is directed to an electronic docking connector for edge mounting an electronic device, such as a daughter board, to a mother board. The connector comprises a pair of housing members assembled to define an elongated slot planarly aligned with the edge of the mother board. Mounted therein is a pair of opposed force applying, resilient spring members operatively mounted for receiving and applying a compressive force against the electronic device. A flexible film member, containing electrical circuitry thereon, is also mounted within said housing members for electrically interconnecting corresponding circuitry on the mother board, and the electronic device. As an alternative, a dielectric insert is disposed between each spring member and its corresponding flexible film to reduce or eliminate cross talk therein.

6 Claims, 5 Drawing Sheets

COPLANAR COMPUTER DOCKING APPARATUS

This application is a Continuation of application Ser. No. 08/102,659 filed Aug. 5, 1993, now abandoned.

RELATED APPLICATION

The invention hereof represents an alternative approach to the coplanar computer docking system disclosed in U.S. patent application, Ser. No. 08/089,867, filed Jul. 12, 1993, now U.S. Pat. No. 5,295,852, particularly where space for utilizing a computer docking system is at a premium.

BACKGROUND OF THE INVENTION

This invention, like the related application, is directed to electronic apparatus, such as a computer docking connector. More particularly, the invention hereof relates to a coplanar docking connector fixedly edge mounted to a "mother" board, where a "daughter" board, memory card, or similar device is inserted, essentially under low or zero force, into said connector to electrically interconnect the mother board to the inserted device to provide a PCMCIA type interface connection.

The assignee of this invention has been actively involved in developing computer docking systems, as exemplified by U.S. patent applications, Ser. No. 07/995,474, now U.S. Pat. No. 5,310,358, and Ser. No. 07/995,615, both of which were filed Dec. 22, 1992, and by two later filed patent applications, Ser. No. 08/056,522, filed Apr. 28, 1993, and Ser. No. 08/089,867, filed Jul. 12, 1993. In the '474 application, the docking system includes a docking station having an electrical member provided with at least one circuit element thereon, and a device for slidably insertion into the docking station which has at least one circuit element thereon. A connector housing within the docking station has a flexible electrical connector providing a circuit interface between the circuit elements on the electrical member and the device, respectively. The device has at least one camming protrusion formed thereon, and the docking station has a camming surface engaging the camming protrusion as the device is slidably inserted into the docking station. Because of the camming action, the device is deflected relative to the connector housing in a direction which is substantially transverse to the direction in which the device is slidably inserted into the docking station, thereby assuring a substantially zero insertion force for the circuit interface, and thereby preserving the structural integrity and hence the reliability of the circuit interface within the docking station. Upon full insertion of the device, the camming protrusion is received in a recess means in the docking station.

In the docking system disclosed in the '615 application, a computer is provided with a guide housing within which a device is slidably inserted. In one embodiment, the device carries a pair of manually-releasable spring-loaded latches pivotally mounted thereon about respective axes which are substantially perpendicular to the direction in which the device is slidably inserted into the guide housing for engagement with respective hooks on the computer. In another embodiment, the latches are pivotably mounted on the guide housing about respective axes which are substantially parallel to the direction in which the device is slidably inserted into the guide housing. The guide housing includes a fixed bottom portion on which the latches are pivotably mounted, and further includes a spring-loaded movable top portion receiving the device and ultimately nested telescopically within the fixed bottom portion. In each embodiment, a substantially zero insertion force ("ZIF") is achieved between at least one flexible electrical connector and a circuit pad as the device is inserted into the guide housing.

One of the latest docking systems, as disclosed in the '522 application, is a system which slidably receives a device to make, break or tap functions, respectively, in a circuit interface. The circuit interface includes a pair of connector housings provided with flexible, i.e. compressible, electrical connectors respectively. A camming means separates the connector housings as the device is slidably inserted into the docking station, thereby assuring a substantially zero insertion force on the circuit interface. Preferably, the circuit interface is between the flexible electrical connectors, a printed circuit board, and a flexible etched circuit. The flexible etched circuit is provided with a stiffener resiliently biased by springs.

The fourth system noted above represents a further approach in providing a coplanar docking system that offers low cost, is highly reliable, and offers a high cycle life, while satisfying the requirements of a PCMCIA type interface. The approach thereof incorporates the use of a pair of spring biased, hermaphroditic, resilient housing members, into which a flexible film member is placed to provide the necessary electrical interconnection. A preferred flexible film member may comprise a plurality of closely-spaced conductive elements or traces photographically etched or otherwise formed on a flexible film, a product sold under the trademark, "AMPLIFLEX", by AMP Incorporated of Harrisburg, Pa.

While the latter system utilizes a pair of housing members which yield or flex upon insertion of the "daughter" board, the apparatus of the present invention relies upon a pair of opposing, yieldable or cantilevered spring members within the respective housing members, where such spring members apply a normal force against a flexible film, such as AMPLIFLEX, by way of example, disposed between said members and the boards or planar electronic devices to be electrically connected thereby. This will become more apparent in the description which follows, particularly when read in conjunction with the accompanying drawings.

SUMMARY OF THE INVENTION

This invention relates to electronic apparatus, such as a coplanar computer docking connector. A preferred embodiment is a connector for electrically connecting a "daughter" board, memory card, or similar device, to a "mother" board. In such preferred embodiment, the apparatus, intended for card edge mounting an electronic device to a mother board, for example, comprises a pair of fixed housing members mounted to the "mother" board, having a laterally disposed elongated slot for receiving a "daughter" board therein. Within the assembled housing members a pair of opposed, resilient force applying spring members are provided, where each said spring member comprises a pair of end wings or mounting ears to be fixedly secured between said housing members on said "mother" board, and a laterally arranged, resilient central portion mounted for flexible movement between said mounting ears by means of narrow webs. Further, one or a pair of flexible film members are mounted within said assembled housing and supported preferably by an elastomeric compressive member carried by the resilient central portion of the spring members, where such film contains electrical circuitry thereon for electrically interconnecting corresponding circuitry on one or both sides of the "mother" board and "daughter" board. Finally, each said central portion is preferably provided with a pair of camming bumps which are intended to ride along the surface of the "daughter" board upon insertion of said "daughter" board into said elongated slot. This action effects a separation of the respective central portions, thereby allowing the "daughter" board to be inserted within the assembled housing without damaging the circuitry on the flexible film.

BRIEF DESCRIPTION OF DRAWINGS

FIG. 3 is an enlarged sectional view, taken essentially along line 3—3 of FIG. 1, showing a "daughter" board electrically connected to a "mother" board.

DETAILED DESCRIPTION OF PREFERRED EMBODIMENT

Figure 1:
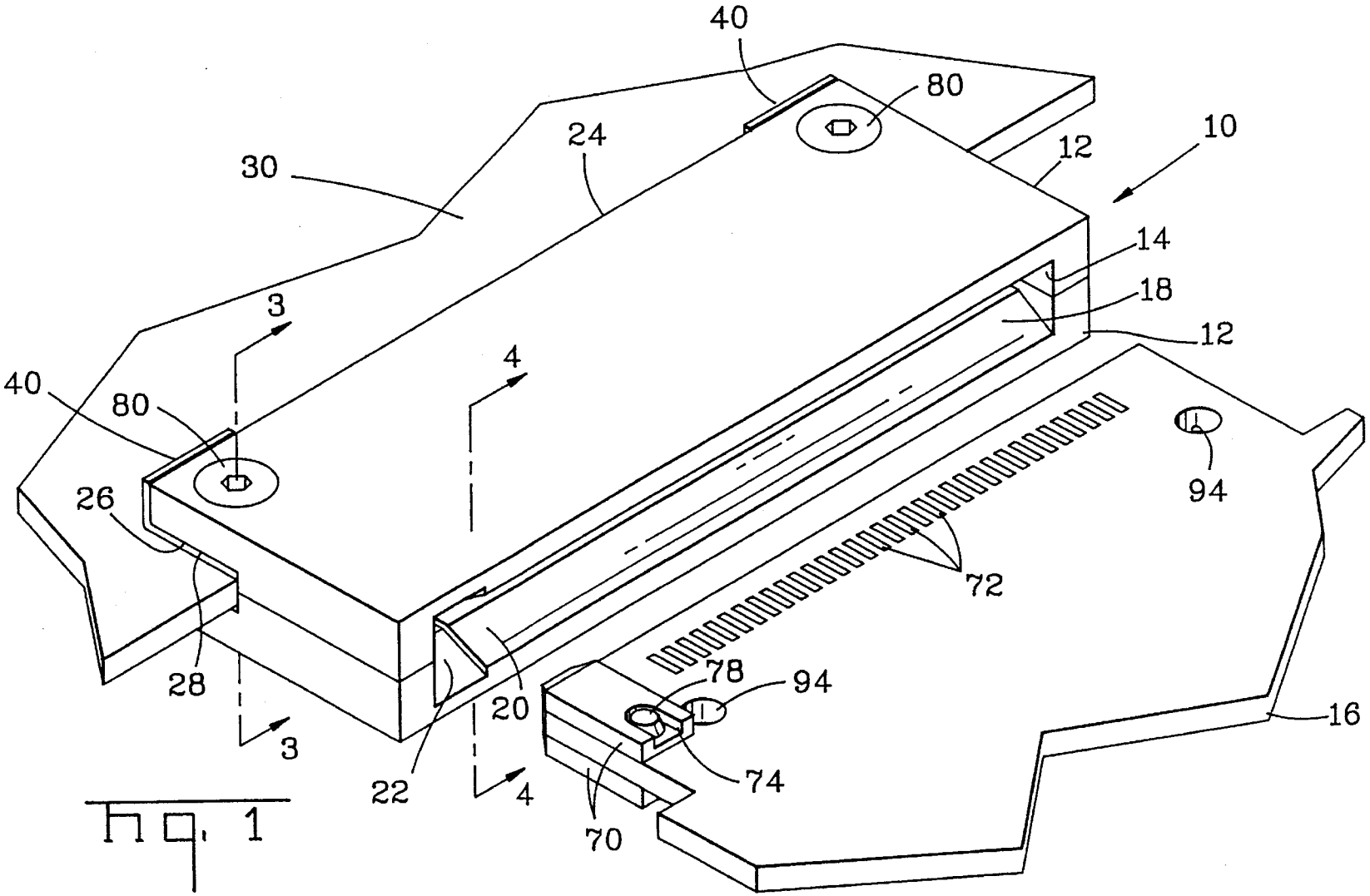
FIG. 1 is a perspective view of the computer docking apparatus of this invention, where such apparatus is mounted along the edge of a "mother" board for receiving a "daughter" board.
Figure 2:
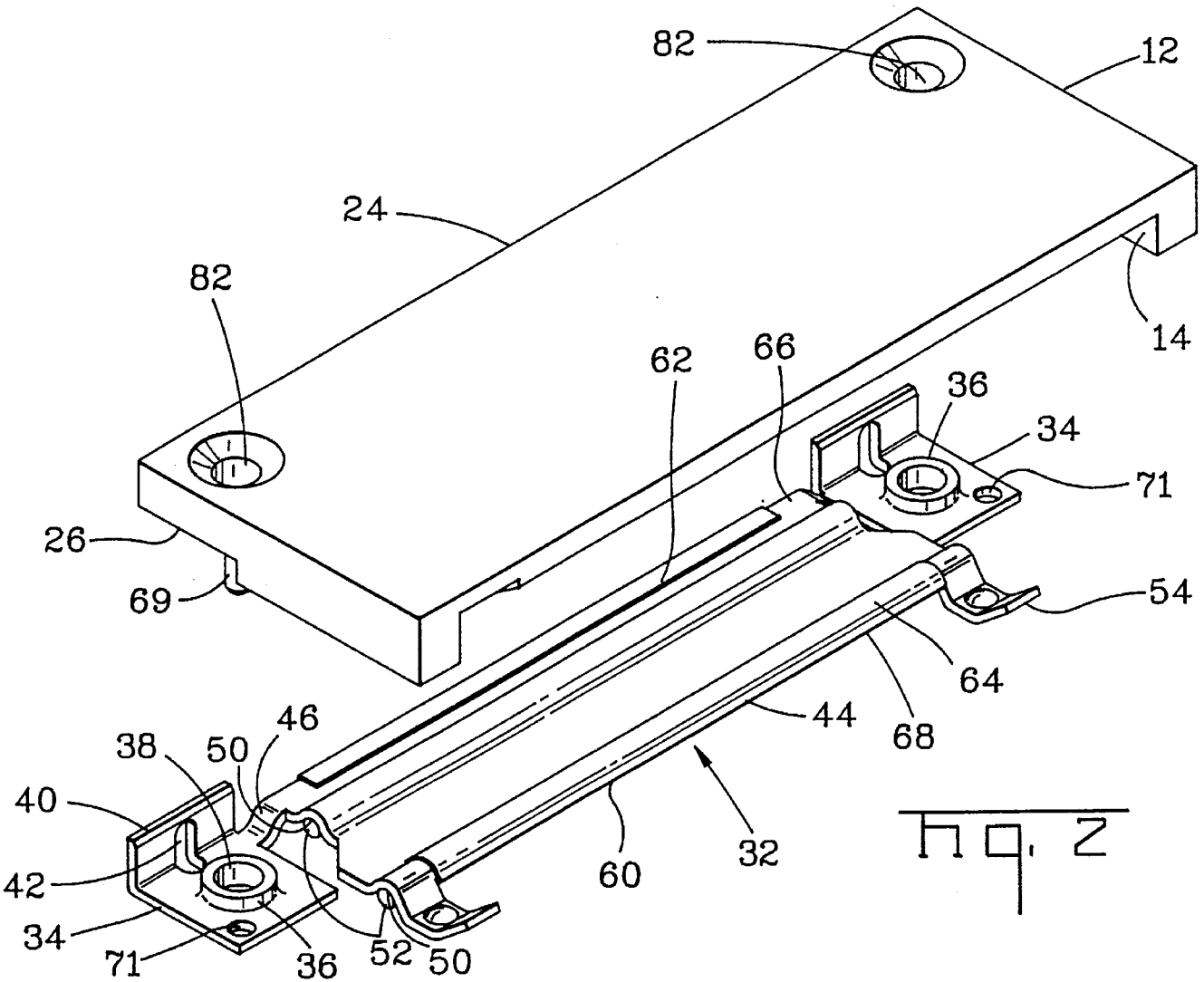
FIG. 2 is an exploded perspective view of a single housing member and a force applying spring member for fixedly mounting therewithin.

This invention is directed to an electronic apparatus, such as a coplanar docking connector for edge mounting a "daughter" board to a "mother" board, by way of example. For convenience, the further description will relate primarily to the connector for electrically interconnecting a daughter board to a mother board. However, it should be recognized that other planar electronic devices may be used, where they share in common the features of being of planar construction having electrical circuitry thereon, in the form of traces or pads. With this understanding, reference may be made to FIGS. 1 and 2 illustrating the connector components of a preferred connector of this invention. In such Figures, the connector 10 of this invention comprises a pair of essentially hermaphroditic housing members 12 having an elongated edge recess 14, which, when such housing members are assembled define a unitary housing having a daughter board 16 receiving slot 18. The slot 18 is further characterized by opposing tapered portions 20 throughout most of the lateral dimension of the slot 18, and by a tapered board alignment channel 22, a feature discussed in greater detail hereinafter.

The rear 24 of the respective housing members 12 include complementary reduced portions 26, which in the housing assembled or mated condition of the two housing members define a lateral through slot 28 to receive and be secured to the mother board 30, as hereinafter explained.

FIG. 2 illustrates one of a pair of the force applying, resilient spring members 32 mounted within the assembled housing. Each spring member 32 comprises a pair of end wings or mounting ears 34, which may include a central boss 36, having a hole 38 therein, a rear flange 40 with a slot 42, for receiving bump or projection 42 on the rear of housing member 12, and an elongated, resilient central portion 44 between said mounting ears 34. The central portion 44 is joined to the respective mounting ears 34 by narrow webs 46 which allow for some relative twisting movement, as hereinafter explained, between the central portion 44 and mounting ears 34. The central portion 44, preferably stamped and formed from a sheet metal blank, is characterized by a pair of parallel, laterally disposed channels 50, for receiving a pair of elongated, elastomeric compressive members 52, and a pair of camming bumps or arms 54 projecting away from the daughter board receiving slot 18. As may be appreciated from the discussion which follows, a pair of camming bumps 54, one from each central portion 44, cooperate to effect movement of said central portions 44 when a daughter board is inserted therebetween. Finally, as more clearly illustrated in FIGS. 4 to 6, a flexible film 60, having electrical circuitry along its face, is wrapped about the central portion 44 along the exposed channels 50 in contact with the elastomeric compressive members 52. In operation, the elastomeric compressive members 52, carried by the respective channels 50, bear against the flexible film 60. Further, the film ends 62, 64 may be wrapped about the edges 66, 68, respectively, and secured in position by means known in the art. The respective housing members 12 may optionally include alignment pins 69 to be received in holes 71.

Turning now to FIG. 3, and back to FIG. 1, it will be noted that the daughter board 16 has been provided with a pair of surface mounted members 70, preferably one on each major surface of the daughter board 16, that is positioned thereon in relation to the circuit traces or pads 72. That is, such members 70 are intended to align the pads on the daughter card to the pads on the mother board. In any case, each such member 70 includes a recess 74 having a hole 76 therethrough, where such hole is aligned with a corresponding hole 77 in the daughter board. When mounted, the respective members 70 are oriented in opposite directions. Each such member 70 includes a projection 78, whose end 80 features a flange or shoulder 82. By this arrangement, when the members 70 are brought into engagement with the daughter board 16, the respective projections 78 extend into and through holes 77 to engage the recess 74 of the other member 70.

Figure 4:
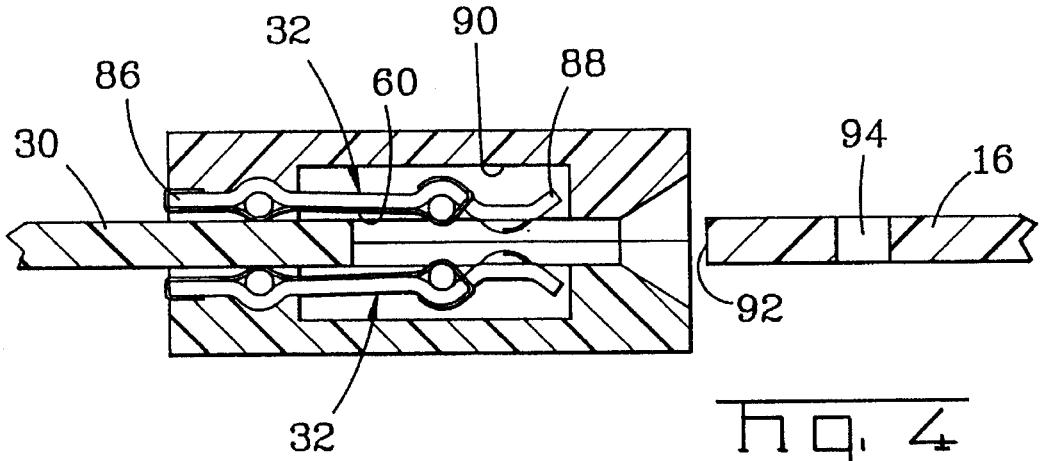
FIGS. 4 to 6 are sectional views, showing the sequential loading of the connector apparatus of this invention, where such views are taken essentially along the line 4—4 of FIG. 1.

To assemble or mount the connector 10 to the mother board 30, the housing member 12 is first brought into engagement with flange 40, where the bump or projection 43 enters into slot 42. This provides a temporary retention of such members prior to mounting of same to the mother board 30. Thereafter, a pair of fasteners 80, see FIG. 3, are inserted through housing holes 82 and secured by nuts 84 in a manner well known in the art. In this arrangement, with the resilient spring members 32 and flexible film 60 wrapped thereabout, as described above, within the respective housing members 12, it will be seen in FIG. 4 that the end 86 thereof is securely captured between the assembled housing members 12 with the circuitry of film 60 in contact with corresponding circuitry on the motherboard 30. However, the remote end 88 is free to move upward within the housing recess 90 to effect loading and unloading of the connector 10. This operation may be illustrated by the sequence of FIGS. 4 to 6. FIG. 4 shows the opposing spring members 32 awaiting receipt of the daughter board 16. As the daughter board is inserted into the slot 18, the forward edge 92 thereof engages the camming bumps 54 causing the pair to spread allowing the further entry of the daughter board 16 into the connector. When the daughter board is fully received therein, the respective camming bumps 54 drop into the camming relief holes 94 in the daughter board 16. With such camming bumps 54 seated therein, the daughter board 16 is firmly held within the connector in electrical contact with the circuitry of film 60.

Figure 7:
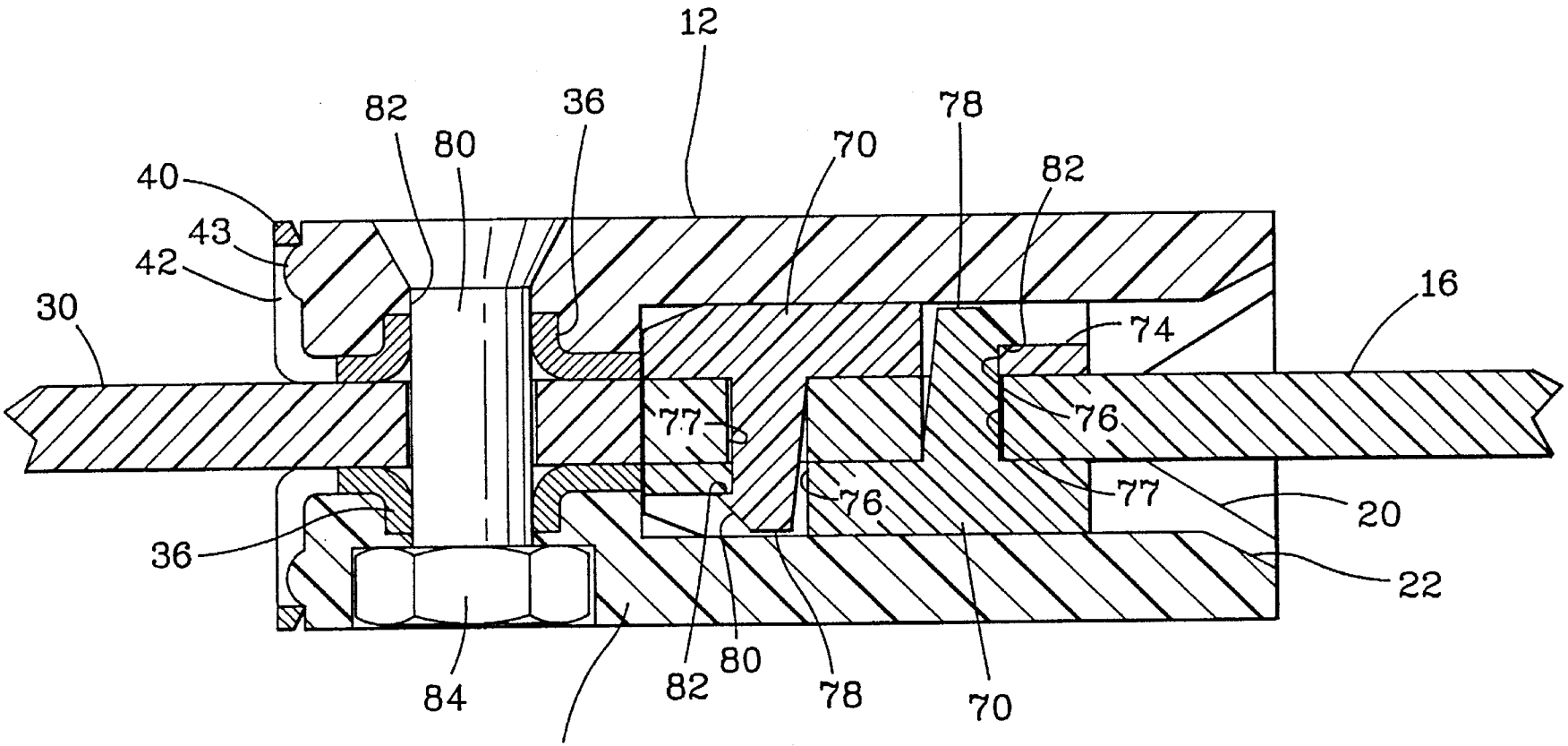
FIGS. 7 and 8 are sectional views, similar to FIGS. 5 and 6, respectively, showing an alternative embodiment for the force applying spring member according to this invention.
Figure 5:
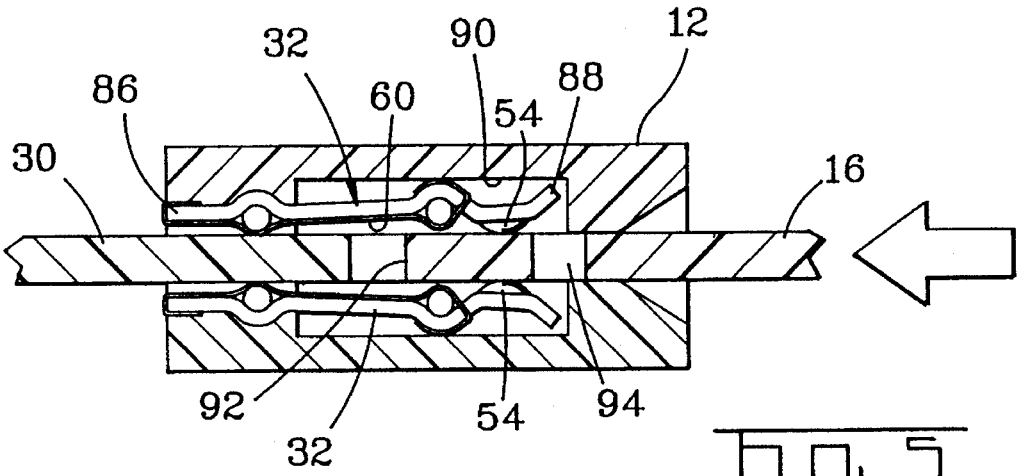
Figure 6:
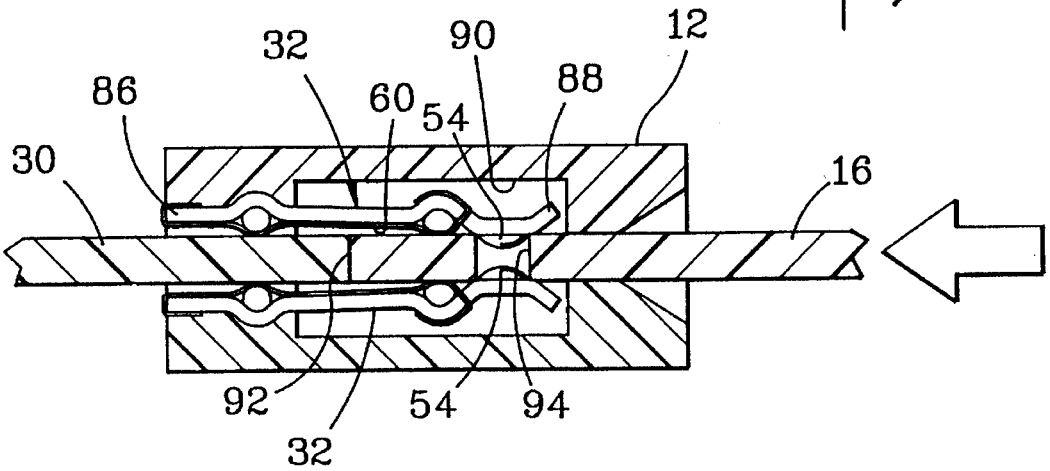
Figure 7:
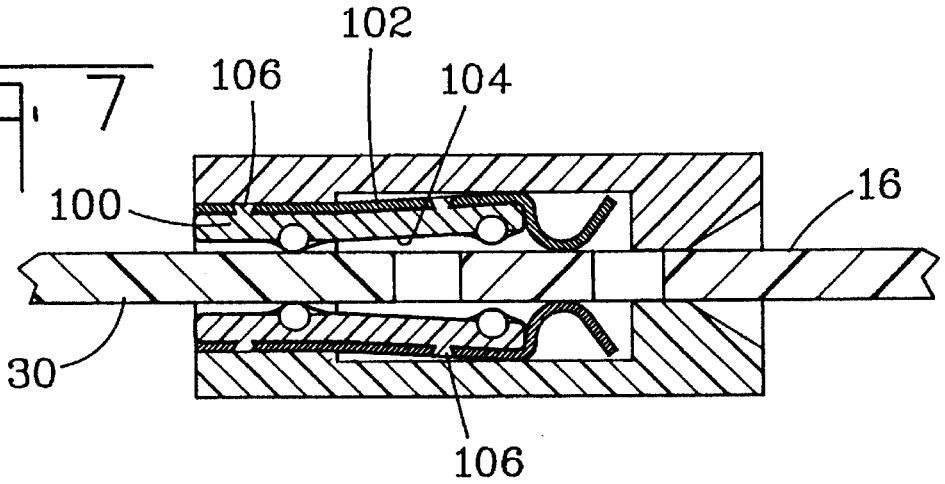
Figure 8:
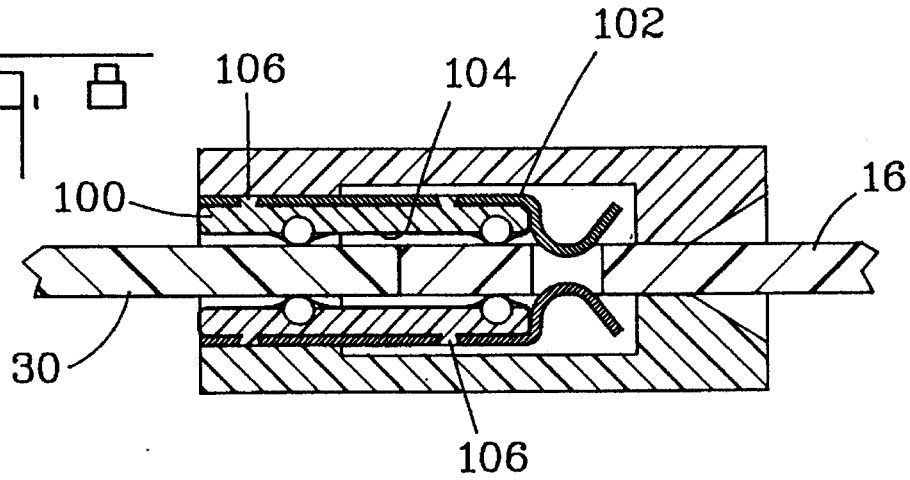
Figure 9:
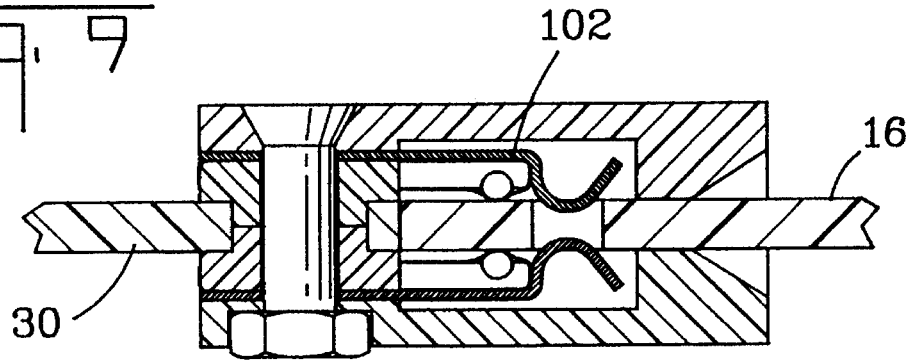
FIG. 9 is a sectional view similar to FIG. 8, but taken along a different plane.

FIGS. 7–9 represent an alternate embodiment to that shown in FIGS. 4 to 6. In this alternate embodiment, intended to reduce or eliminate cross talk, there is incorporated a plastic or dielectric insert 100 between the force applying spring member 102 and flexible film 104. By this arrangement, the circuitry of the film 104 is spaced from the spring member 102, typically formed from a sheet metal blank. To secure the insert 100 to the spring member 102, posts 106 may be provided along the upper surface thereof for heat staking, a procedure well known in the art for securing two members together.

Finally, while it will be noted that only a single row of contact, both surfaces, is illustrated in the two embodiments for the mother board and daughter board, it should be understood that plural contacts may be provided by the addition of further elastomeric cores about which the flexible film may be wrapped and/or supported.

We claim:

1. An electronic docking connector for edge mounting an electronic device, such as a daughter board, to a motherboard, said connector comprising a pair of housing members assembled to define an elongated slot planarly aligned with the edge of said mother board, a pair of opposed force applying, resilient spring members having first and second ends, where said first ends are fixedly secured within the assembled housing members in a cantilevered fashion and said second ends are free to move away and toward each other, said spring members further including a pair of laterally extending mounting tabs joined to a flexible central portion by narrow webs, where said mounting tabs are fixedly secured within said assembled housing, and that said central portion includes at least a pair of laterally extending grooves for receiving an elastomeric compressive member, having a flexible film thereabout adjacent to said member, whereby said spring members are operatively mounted within said housing members for receiving and applying a compressive force against said electronic device, and that said flexible film includes electrical circuitry thereon for electrically interconnecting corresponding circuitry on said mother board and said electronic device.

2. The electronic docking connector according to claim 1, wherein a dielectric insert is provided between said spring member and said flexible film, whereby to reduce crosstalk.

3. An electronic docking connector for edge mounting a first electronic device to a second electronic device, said connector comprising:

a.) a pair of essentially identical housing members, each said housing member having (i.) a recess extending from an edge along a first end, whereby when said housing members are assembled said recesses define a central cavity opening into an elongated slot along said edge, and (ii.) a second end fixedly secured to said first electronic device, (b.) a pair of opposed force applying, resilient spring members operatively mounted within said cavity to effect a spreading of said cavity during loading thereof by said second electronic device, and that when fully loaded said resilient spring members apply a compressive force against said second electronic device, a first end of each said spring member being fixedly secured within the assembled housing members in a cantilevered fashion, and a second end thereof being free to move away from and toward the second end of its complementary spring member, said resilient spring members including a pair of laterally extending mounting tabs joined to a flexible central portion by narrow webs, said mounting tabs being fixedly secured within said assembled housing, and (c.) a flexible film member containing electrical circuitry thereon mounted within said cavity intermediate said force applying member and said second electronic device for electrically interconnecting respective circuitry on said first and second electronic devices.

4. The electronic docking connector according to claim 3, wherein said electronic device includes a circuitry alignment member mounted thereon, where said member cooperates with a channel disposed along said elongated slot.

5. The electronic docking connector according to claim 3, wherein said central portion includes a pair of axially extending camming arms to effect movement of said central portion when contacted by said electronic device.

6. The electronic docking connector according to claim 5, wherein said electronic device includes a camming relief notch for receiving said camming arms when said electronic device is fully inserted into said slot.

* * * * *